US010265877B2

(12) United States Patent
Bucks

(10) Patent No.: US 10,265,877 B2
(45) Date of Patent: Apr. 23, 2019

(54) IMPELLER FOR CENTRIFUGAL FOOD CUTTING APPARATUS AND CENTRIFUGAL FOOD CUTTING APPARATUS COMPRISING SAME

(71) Applicant: FAM, Kontich (BE)

(72) Inventor: Brent L. Bucks, Lakewood Ranch, FL (US)

(73) Assignee: FAM, Kontich (BE)

( * ) Notice: Subject to any disclaimer, the term of this patent is extended or adjusted under 35 U.S.C. 154(b) by 822 days.

(21) Appl. No.: 14/347,533

(22) PCT Filed: Sep. 28, 2012

(86) PCT No.: PCT/EP2012/069297

§ 371 (c)(1),
(2) Date: Mar. 26, 2014

(87) PCT Pub. No.: WO2013/045685

PCT Pub. Date: Apr. 4, 2013

(65) Prior Publication Data

US 2014/0230621 A1 Aug. 21, 2014

Related U.S. Application Data

(60) Provisional application No. 61/540,291, filed on Sep. 28, 2011.

(51) Int. Cl.
*B26D 7/06* (2006.01)
*B26D 1/36* (2006.01)
(Continued)

(52) U.S. Cl.
CPC ..... *B26D 7/0691* (2013.01); *B26D 1/36* (2013.01); *B26D 7/00* (2013.01); *B26D 7/08* (2013.01);
(Continued)

(58) Field of Classification Search
CPC ..... B26D 7/00; B26D 7/2628; B26D 7/08; B26D 1/36; B26D 7/0691; Y10T 83/6473
(Continued)

(56) References Cited

U.S. PATENT DOCUMENTS 4,063,565 A * 12/1977 Edwards ..... A23N 12/023 134/104.3
4,391,172 A * 7/1983 Galland ..... B26D 1/02 83/403
(Continued)

FOREIGN PATENT DOCUMENTS

WO 02083377 10/2002

OTHER PUBLICATIONS

European Patent Office International Search Report dated Jan. 4, 2013, International Application No. PCT/EP2012/0696297 (2 pages).
(Continued)

*Primary Examiner* — Sean Michalski
*Assistant Examiner* — Fernando Ayala
(74) *Attorney, Agent, or Firm* — Koppel, Patrick, Heybl & Philpott

(57) ABSTRACT

Impeller for a centrifugal food cutting apparatus, comprising a base plate and at least one set of paddle parts mounted on the base plate and provided for imparting centrifugal force to food products to be cut. Each set comprises inner and outer paddle parts defining at least a first stage and a second, cutting stage, the inner and outer paddle parts being offset from each other in radial and angular direction of the impeller, such that a safe compartment is defined for food product which is in the second stage.

20 Claims, 16 Drawing Sheets

(51) Int. Cl.
*B26D 7/00* (2006.01)
*B26D 7/08* (2006.01)
*B26D 7/26* (2006.01)

(52) U.S. Cl.
CPC ..... *B26D 7/2614* (2013.01); *B26D 7/2628* (2013.01); *Y10T 83/6473* (2015.04)

(58) Field of Classification Search
USPC ..... 83/403, 403.1
See application file for complete search history.

(56) References Cited

U.S. PATENT DOCUMENTS 4,604,925 A * 8/1986 Wisdom ..... B26D 1/03 144/162.1
5,042,730 A * 8/1991 Hundt ..... B02C 18/143 144/176
7,658,133 B2 2/2010 Jacko et al.
2002/0066261 A1* 6/2002 Richards ..... B65F 1/062 53/574
2002/0144584 A1* 10/2002 Arrasmith ..... B26D 1/02 83/663
2006/0260457 A1* 11/2006 Ohsugi ..... B26D 1/03 83/487
2008/0022822 A1* 1/2008 Jacko ..... B26D 1/03 83/403
2009/0202694 A1* 8/2009 Julian ..... B26D 1/38 426/506
2010/0263510 A1 10/2010 Klockow et al.

OTHER PUBLICATIONS

Belgian Patent Office Search Report and Written Opinion dated Aug. 12, 2013, Belgian Application No. 2012/00646 (8 pages).

* cited by examiner

IMPELLER FOR CENTRIFUGAL FOOD CUTTING APPARATUS AND CENTRIFUGAL FOOD CUTTING APPARATUS COMPRISING SAME

TECHNICAL FIELD

The present invention relates to an impeller for a centrifugal food cutting apparatus and a food cutting apparatus equipped with such an impeller.

BACKGROUND ART

A centrifugal food cutting apparatus comprises an impeller which can rotate concentrically within a cutting head to impart centrifugal force to the products to be cut.

A centrifugal food cutting apparatus is for example known from U.S. Pat. No. 7,658,133.

DISCLOSURE OF THE INVENTION

It is an aim of this invention to provide an improved impeller for a centrifugal food cutting apparatus.

This aim is achieved with the impeller comprising the technical characteristics of the first claim.

As used herein "offset in radial direction" is intended to mean that the respective parts are located on different distances from the centre of a circle, in particular the rotation centre of the impeller.

As used herein "offset in angular direction" is intended to mean that the respective parts are located on different diameter lines of a circle, i.e. diameter lines of the circle intersecting each other in the centre of the circle with a non-zero angle in between, in particular different diameter lines of the impeller.

As used herein, "rotational speed" is intended to mean the speed at which an object rotates around a given axis, i.e. how many rotations the object completes per time unit. A synonym of rotational speed is speed of revolution. Rotational speed is commonly expressed in RPM (revolutions per minute).

As used herein, "cutting velocity" is intended to mean the speed at which a cutting element cuts through a product or alternatively states the speed at which a product passes a cutting element. Cutting velocity is commonly expressed in m/sec.

As used herein, a "cutting element" is intended to mean any element which is configured for cutting a particle or a piece from an object or otherwise reducing the size of the object, such as for example a knife, a blade, a grating surface, a cutting edge, a milling element, a comminuting element, a cutting element having multiple blades, etc., the foregoing being non-limiting examples.

The invention provides an impeller for a centrifugal food cutting apparatus, comprising a base plate and at least one set of paddle parts mounted on the base plate and provided for imparting centrifugal force to food products to be cut. Each set comprises inner and outer paddle parts defining at least a first stage and a second, cutting stage, the inner and outer paddle parts being offset from each other in radial and angular direction of the impeller, such that a safe compartment is defined for food product which is in the second stage. By providing this safe compartment, disturbance of the food product in the second stage during the cutting by food product entering the cutting head may be avoided. It has been found that this may improve the quality of the cut food product.

According to embodiments of the present invention, the impeller comprises paddles or like elements defining at least a first cutting stage and a second cutting stage. During the first cutting stage, the food product is above a threshold size and is held in a first position by an inner paddle part while being cut. As soon as the food product is reduced to the threshold size or smaller, the food product is moved (by friction with the wall of the cutting head or by hitting a subsequent cutting element on the cutting head) towards a second position where it is held by an outer paddle part while being further cut. The inner and outer paddle parts are offset from each other both in radial and angular direction, such that a safe compartment is defined for the food product which is in the second stage. In this safe compartment, the food product is protected from subsequent food product which enters the cutting head, such that it cannot be struck by this subsequent food product. The threshold size is defined by the distance between the inner paddle parts and the cutting elements of the cutting head surrounding the impeller during use.

Still according to embodiments of the present invention, the impeller can also comprise paddles or like elements defining at least a first, non-cutting stage and a second, cutting stage. During the first stage, the food product entering the cutting head is prevented from hitting food product which is already in the second stage, in a safe compartment defined by the paddle parts. In the first stage, the food product is held in a first position by an inner paddle part without being cut. As soon as the safe compartment is vacated, the food product is moved to the second stage (by friction with the wall of the cutting head or by hitting a cutting element on the cutting head), i.e. towards a second position where it is held by an outer paddle part while being cut. The inner and outer paddle parts are offset from each other both in radial and angular direction, such that a safe compartment is defined for the food product which is in the second stage. In this safe compartment, the food product is protected from subsequent food product which enters the cutting head, such that it cannot be struck by this subsequent food product.

In embodiments according to the present invention, there can be more than two cutting stages, respectively defined by inner paddle parts, (one or more) intermediate paddle parts and outer paddle parts. In such embodiments, there are different threshold sizes, each time defined by the distance between the respective paddle part and the cutting elements of the cutting head surrounding the impeller during use, and different safe compartments, each time defined by the angular and radial offsets between the respective paddle parts.

In embodiments according to the present invention, there can be a single set or multiple sets of inner and outer (and intermediate) paddle parts.

In embodiments according to the present invention, the inner and outer (and intermediate) paddle parts can be separate paddles or can be different parts of the same paddle element, e.g. different parts of a bent sheet metal plate. The inner and outer (and intermediate) paddle parts can have different sizes. Their surface can be smooth or textured (to counteract counterrotation of the food product in contact with the surface). Their surface can further be planar or curved.

In embodiments according to the present invention, the inner and outer (and intermediate) paddle parts can be oriented differently with respect to each other, i.e. be oriented under different angles with respect to the radial direction of the impeller. For example, the outer paddle parts can be oriented at a greater angle with respect to the radial direction of the impeller than the inner paddle parts for pushing food product which is in the second stage more towards the cutting elements than in the first stage. Food product which is in the second stage has already been cut to a smaller size than food product in the first stage, so has less weight and experiences less centrifugal force. This difference in orientation of the paddle parts can compensate for the reduction in weight, so that the cutting action can be more uniform.

In embodiments according to the present invention, the inner and outer (and intermediate) paddle parts can be rotatably mounted on the impeller, such that their orientation and consequently the impelled force can be adapted in view of the food product which is to be cut.

In embodiments according to the present invention, the inner and outer (and intermediate) paddle parts can be repositionally mounted on the impeller, such that their position on the impeller and e.g. the position of the inner paddle parts with respect to the outer paddle parts of the same set can be adapted in view of the food product which is to be cut.

The rotatable mounting and/or repositionable mounting of the paddle parts can for example be achieved by means of a releasable fixing of the paddle parts to the base plate of the impeller, e.g. by means of bolts or in other ways.

For example, for cutting potatoes a preferred range for the offset in angular direction between the inner and outer paddle parts (measured along the periphery of the impeller between the outer edges of the paddle parts) can be 2.0 to 10.0 cm, preferably 4.0 to 6.0 cm.

For example, for cutting potatoes a preferred distance range between inner paddle parts and the periphery of the impeller can be 2.5 to 5.0 cm.

In embodiments according to the present invention, the back side of the paddle parts can be covered with a resilient material for reducing damage to fresh food product entering the cutting head and striking this back side.

BRIEF DESCRIPTION OF THE DRAWINGS

The invention will be further elucidated by means of the following description and the appended drawings.

MODES FOR CARRYING OUT THE INVENTION

Figure 1:
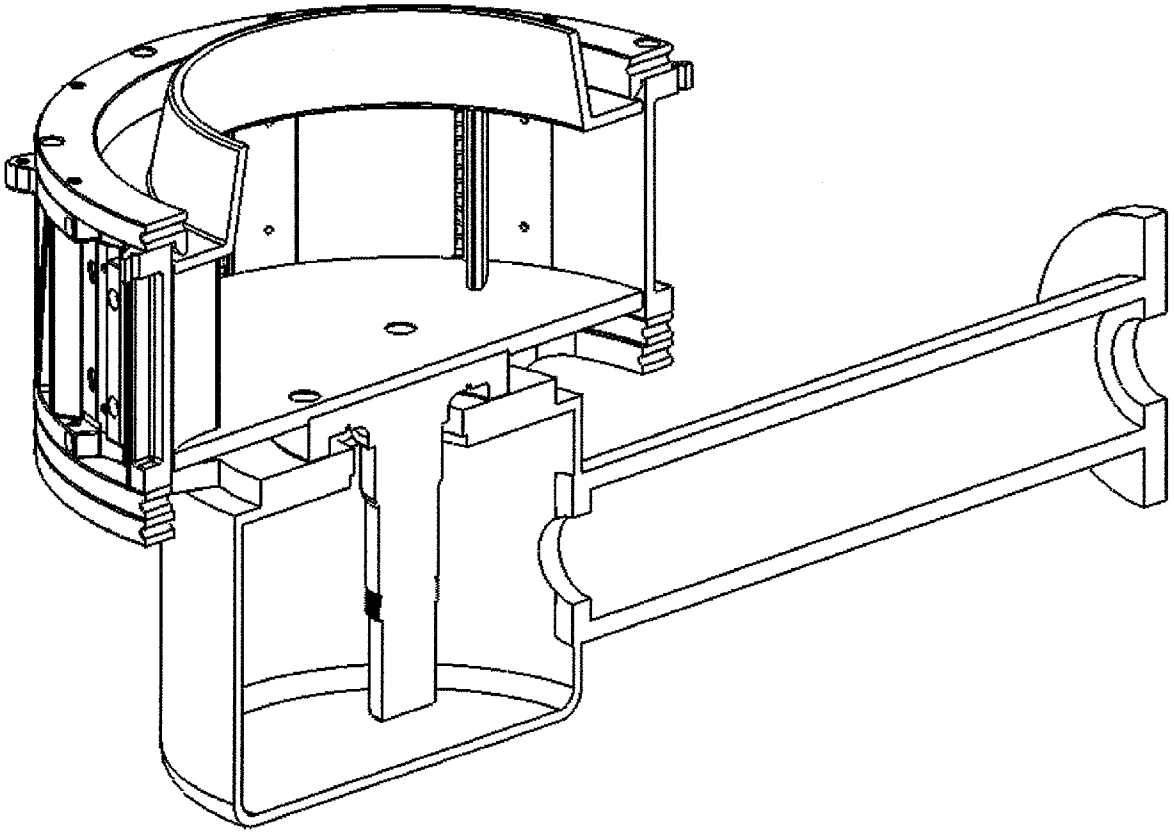
FIG. 1 (prior art)
FIG. 1 shows a prior art centrifugal cutting apparatus.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description and the claims are used for descriptive purposes and not necessarily for describing relative positions. The terms so used are interchangeable under appropriate circumstances and the embodiments of the invention described herein can operate in other orientations than described or illustrated herein.

Furthermore, the various embodiments, although referred to as "preferred" are to be construed as exemplary manners in which the invention may be implemented rather than as limiting the scope of the invention.

The term "comprising", used in the claims, should not be interpreted as being restricted to the elements or steps listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising A and B" should not be limited to devices consisting only of components A and B, rather with respect to the present invention, the only enumerated components of the device are A and B, and further the claim should be interpreted as including equivalents of those components.

FIG. 1 shows a prior art centrifugal food cutting apparatus, but note that it can be equipped with impellers according to the invention. In this apparatus, the cutting head is stationary and only the impeller rotates. The rotation can either be in clockwise or counterclockwise direction (viewed from the top), depending on the orientation of the cutting elements on the cutting head, though clockwise is more common.

Figure 2:
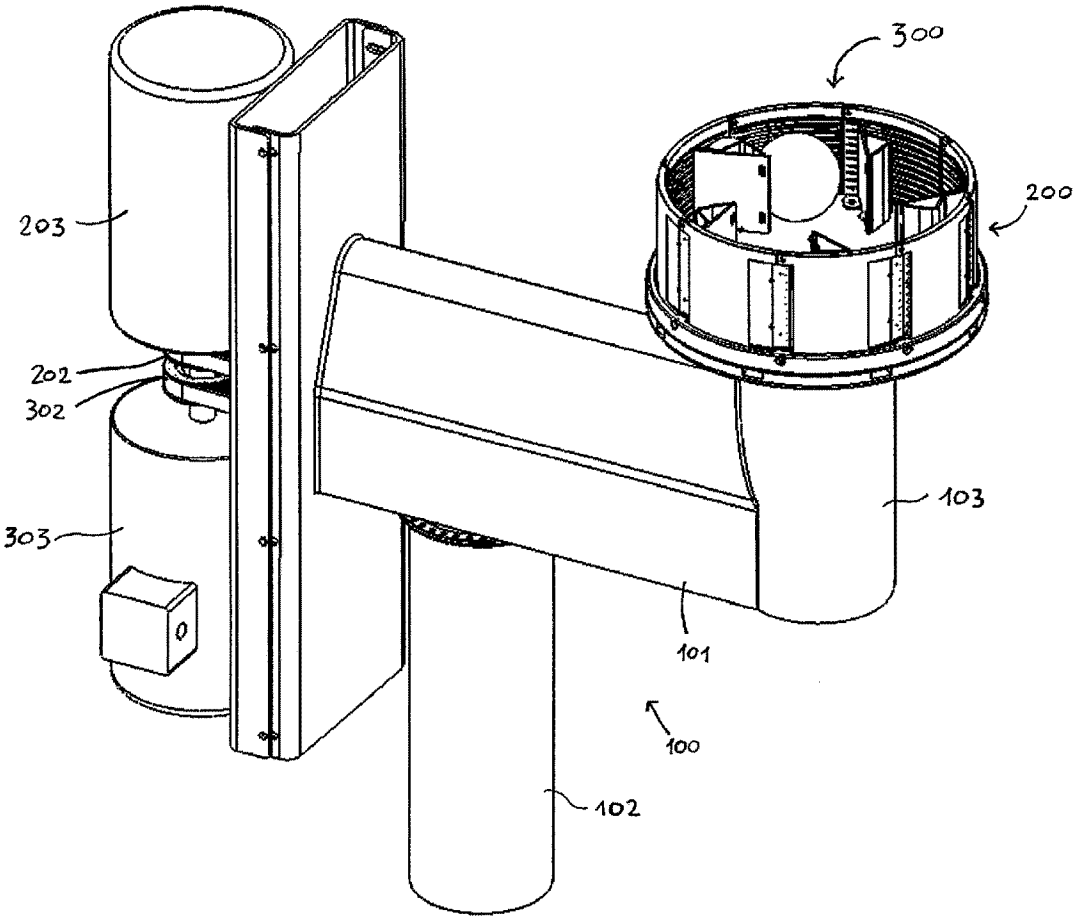
FIG. 2 shows an embodiment of a centrifugal cutting apparatus according to the invention.

FIG. 2 shows a centrifugal food cutting apparatus according to the invention. In this apparatus both the cutting head and the impeller are rotatable. The rotation direction can be both clockwise at different rotational speeds, counterclockwise at different rotational speeds, or opposite directions, as long as the food product is moved towards the periphery by centrifugal force and at the periphery the food product and the knives on the cutting head are moved towards each other for cutting.

The cutting apparatus shown in FIG. 2 (see also FIG. 9) comprises a base 100 which carries a rotatable cutting head 200 and an impeller 300, adapted for rotating concentrically within the cutting head. A first drive mechanism, which is constituted by a first drive shaft 301, drive belt 302 and motor 303, is provided for driving the rotation of the impeller 300. A second drive mechanism, which is constituted by a second drive shaft 201, drive belt 202 and motor 203, is provided for driving the rotation of the cutting head 200. The first and second drive shafts are concentrical. The second drive shaft 201 which drives the cutting head 200 is rotatably mounted by means of bearings 104, 105 inside a stationary outer bearing housing 103, which forms part of the base 100. The first drive shaft 301 which drives the impeller is rotatably mounted by means of bearings 106, 107 inside the first drive shaft 201. As shown, these bearings 104-107 are tapered roller bearings, slanting in opposite directions, which is preferred in view of withstanding the forces which occur during operation of the apparatus. Alternatively, angular contact bearings could be used, or any other bearings deemed suitable by the person skilled in the art.

The base 100 comprises an arm 101, which is rotatably mounted on a post 102, so that the cutting head 200 and impeller 300 can be rotated away from the cutting position for cleaning, maintenance, replacement etc.

Figure 3:
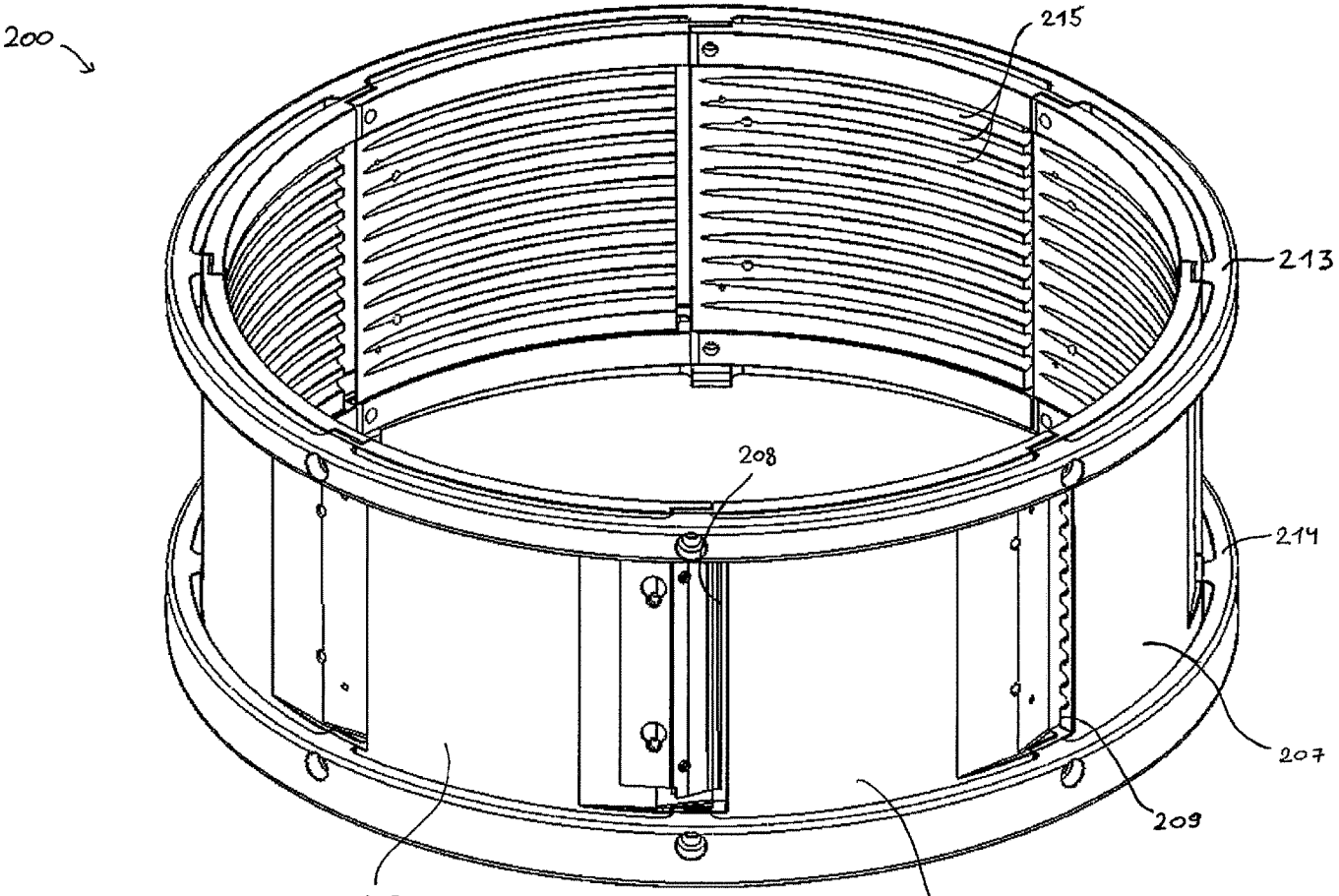
FIG. 3 shows a detail of the cutting head assembly of the apparatus of FIG. 2.
Figure 9:
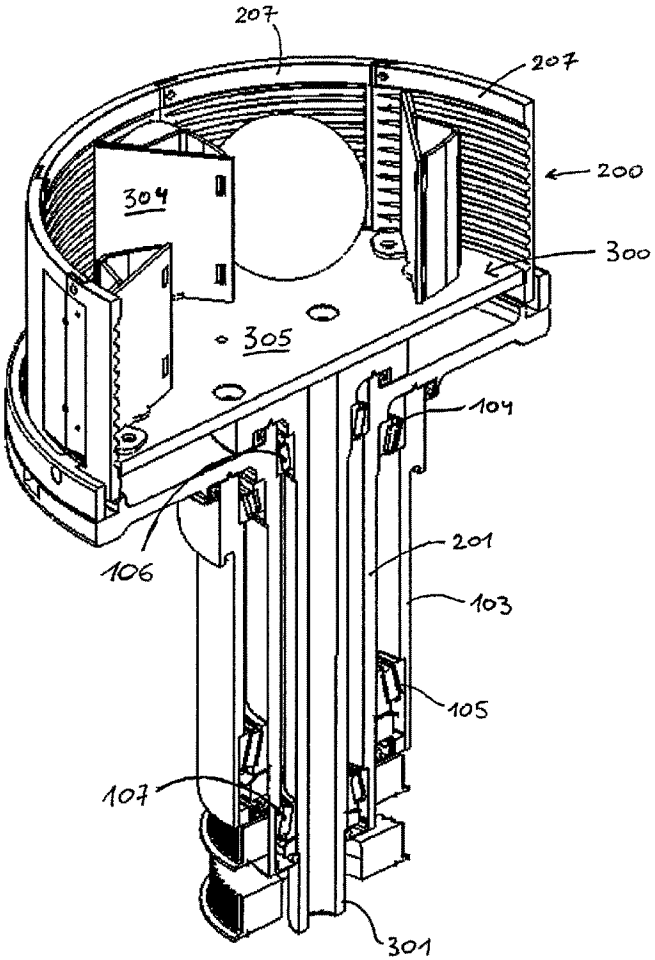
Figure 11:
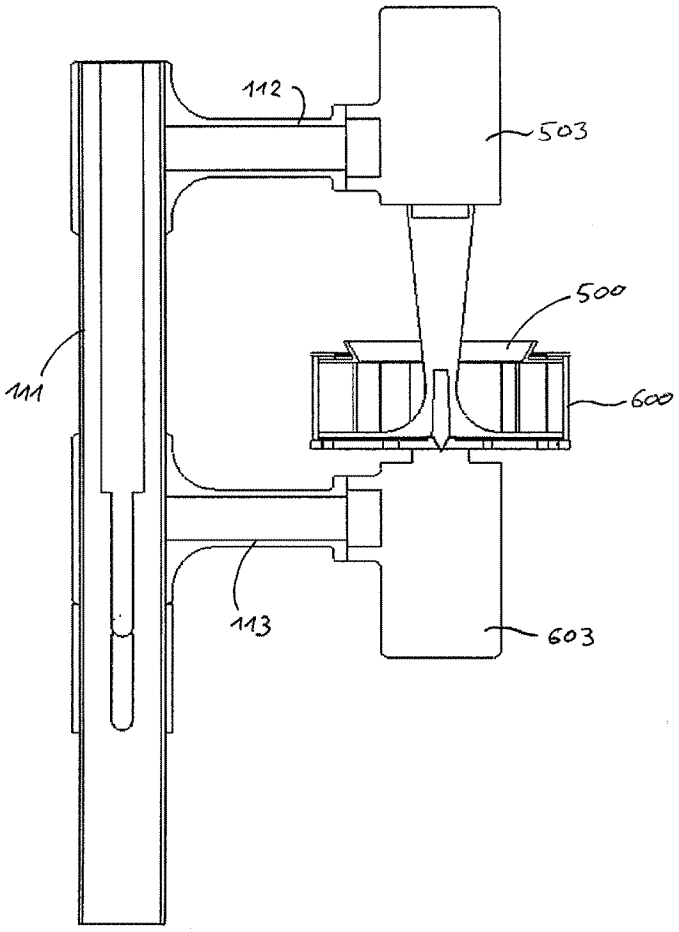
FIGS. 10-14 show an alternative embodiment of a centrifugal cutting apparatus according to the invention.
Figure 10:
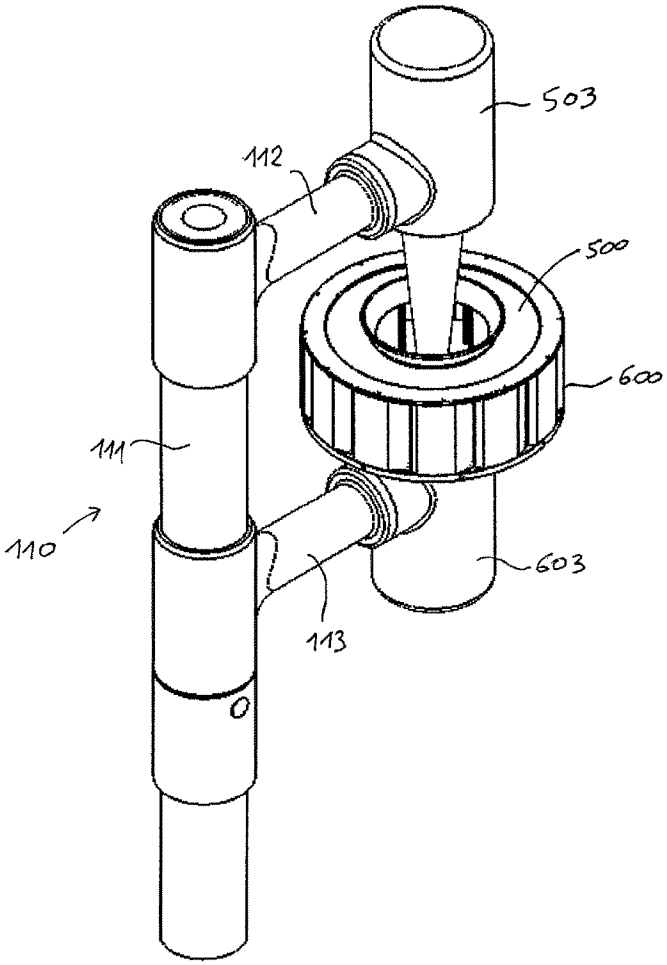
Figure 12:
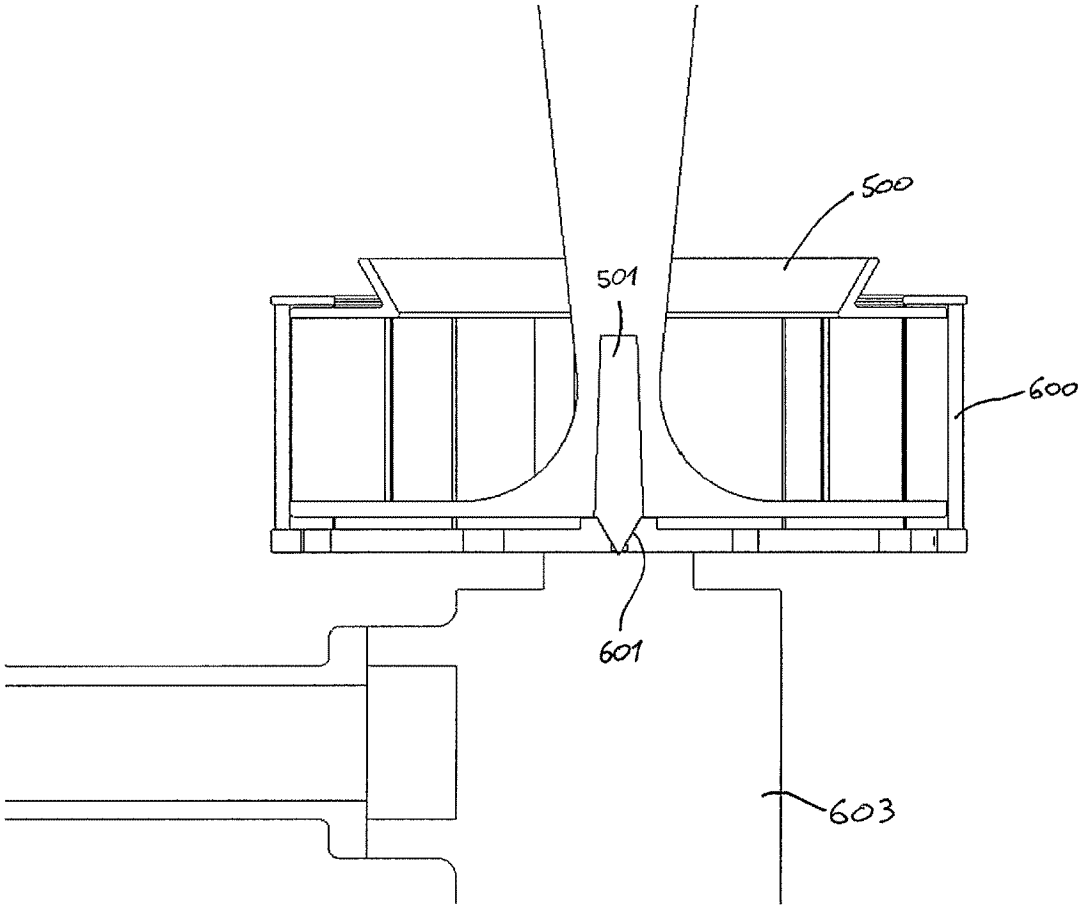

FIG. 9 shows the impeller 300 and cutting head 200 in more detail. The impeller 300 is releasably fixed to the first drive shaft 301 for rotation inside the cutting head 200. The cutting head 200 is a cylindrical assembly comprising a plurality of cutting stations 207 fixed to each other and to mounting rings 213, 214 by means bolts through overlapping parts of the cutting stations, which each comprise one cutting element 208 (only one is shown in FIG. 3). The assembly is releasably fixed to the second drive shaft 201. The cutting stations 207 have an adjustable gap between the cutting element 208 (FIG. 3) and an opposing part 209 (FIG. 3) on the subsequent cutting station, i.e. for adjusting the thickness of the part which is cut off. The top sides of the cutting head 200 and impeller 300 are open. In use, product to be cut is supplied into the cutting head from this open top side, lands on the bottom plate 305 of the impeller and is moved towards the cutting elements 208 firstly by centrifugal force, which is imparted to the product by the rotation of the impeller 300, and secondly by the paddles 304 of the impeller.

In alternative embodiments (not shown), the drum can also be composed of a plurality of drum stations which are not all cutting stations. For example, typically in conjunction with a dicing unit mounted at the outside of the cutting head which is provided for further cutting a slice cut off by the cutting head, there would be only one cutting station.

The cutting head 200 is fitted with cutting elements 208, for example blades which make straight cuts in the product, for example to make potato chips. As an alternative, corrugated cutting elements could be fitted in order to make for example crinkle cut potato chips or shreds.

In an alternative embodiment (not shown), the cutting stations comprise each a larger blade and a number of (one or more) smaller, so-called julienne tabs extending at an angle thereto, in particular substantially perpendicular thereto. In this embodiment, the julienne tabs can be welded onto the larger blades, but they could also be removably fixed thereto. In particular, the julienne tabs can be fixed to and extend perpendicular to the bevel of the larger blades, but they could also be fixed to the larger blades behind the bevel. The front cutting edges of the julienne tabs can be slightly behind the front cutting edge of the larger blade, all at the same distance. Alternatively, they could also be located at varying distances from the front cutting edge of the larger blade, for example in a staggered or alternating configuration. The julienne tabs can be stabilised by means of slots in the subsequent cutting station, so that during operation stresses can be relieved and the desired cut can be better maintained. The slots can extend a given distance into the rear end of the cutting stations to accommodate for the variable positions of the julienne tabs upon varying the gap. With this cutting head, the product is cut in two directions at once. It can for example be used to cut French fries from potatoes or to cut lettuce.

In further alternatives, cutting stations can be used with grating surfaces for making grated cheese, or with any other cutting elements known to the person skilled in the art.

Figure 4:
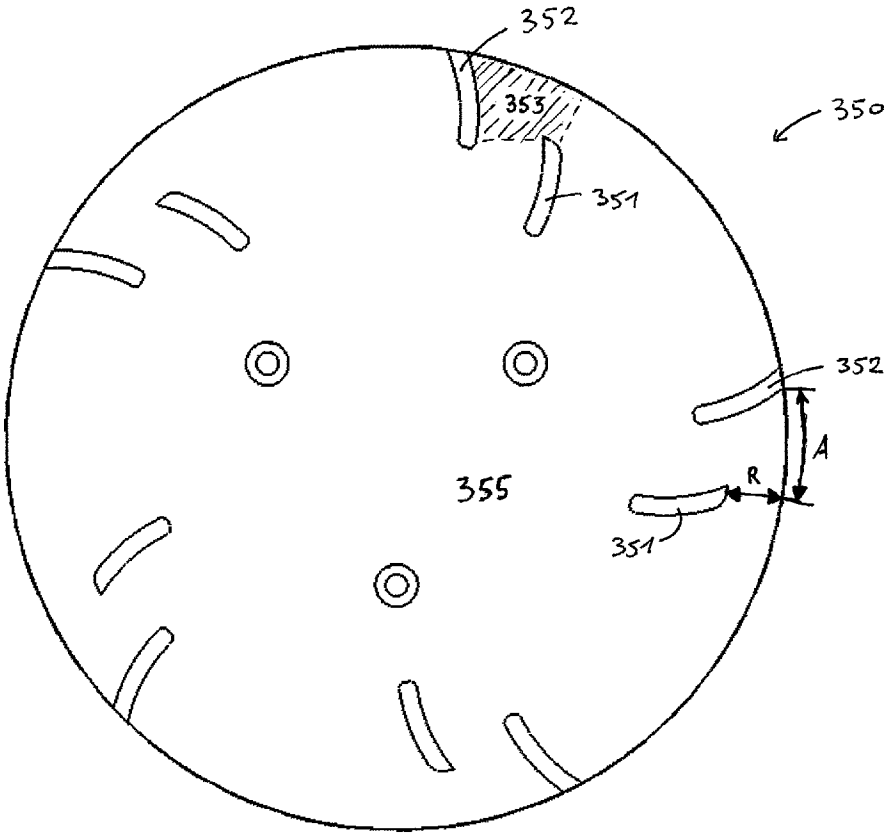
FIG. 4 shows an embodiment of an impeller according to the invention.

FIG. 4 shows a first embodiment of an impeller 350 according to the invention. It comprises a number of sets of outer and inner paddles 351, 352, which are permanently fixed, e.g. welded, to the base plate 355 of the impeller. The outer paddles 352 are located at the periphery of the impeller and the inner paddles 351 are offset from the outer set both in angular direction (by distance "A", measured along the circumference of the impeller) and in radial direction (by distance "R", measured along a diameter line of the impeller). Both the inner and outer paddles function to impart force on food product which is to be cut, such that depending on the direction of rotation, the food product is moved by the paddles towards and is eventually cut by cutting elements 208 on the cutting head 200, or the cutting elements 208 on the cutting head 200 are moved towards the food product which is in this case pressed onto the paddles 351, 352 by the cutting elements cutting into the food product. The inner paddles 351 function in a first stage as long as the food product is above a given threshold size, defined by the distance between the inner paddles and the cutting elements on the cutting head (which is slightly above the distance "R", e.g. a few mm). As soon as the food product is reduced to this threshold size, it is moved towards the outer paddles 352 where it is cut further in a second stage. The advantage is that food product above the threshold size which enters the cutting head cannot strike the food product which is already in the second stage, since the inner paddles 351 form an obstruction. The inner paddles, due to their offset with respect to the outer paddles, define a safe compartment 353 for the food product in the second stage. As a result, the food product in the second stage is not disturbed during the further cutting by food product entering the cutting head, which improves the quality of the cut food product.

Figure 5:
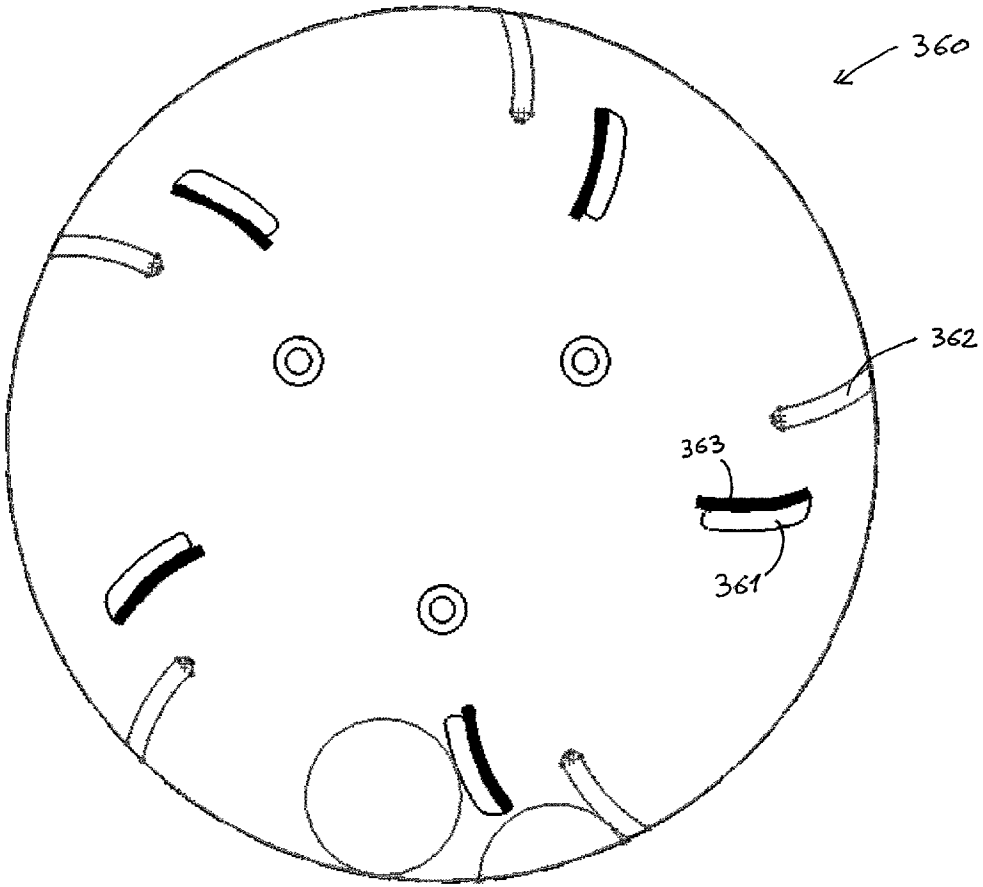
FIG. 5 shows another embodiment of an impeller according to the invention.

FIG. 5 shows a second embodiment of an impeller 360 according to the invention. The impeller is the same as the one in FIG. 3, i.e. having inner and outer paddles 361, 362 defining two cutting stages, except that the back side of the inner paddles 361, which may strike food product which enters the cutting head and starts to travel towards the periphery by centrifugal force, is covered with a resilient material 363 to reduce damage to the food product.

Figure 6:
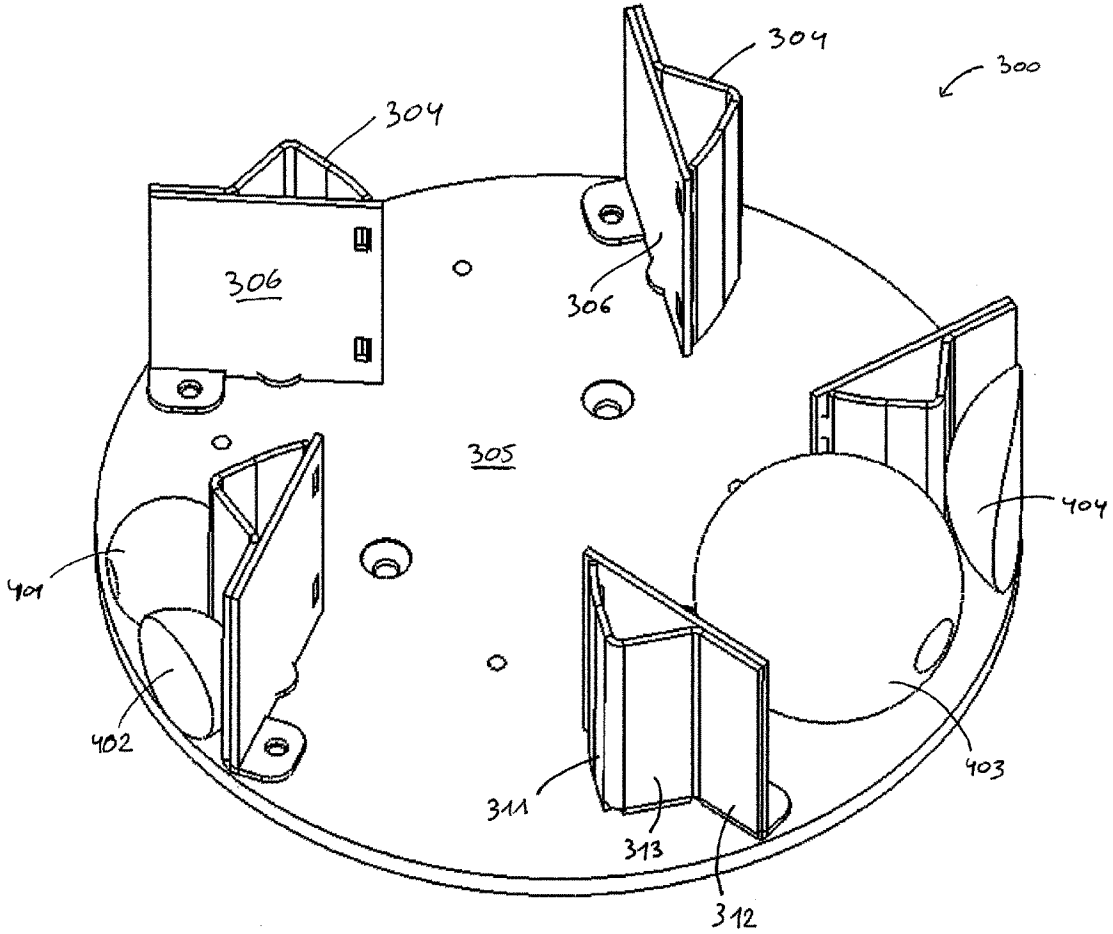
FIGS. 6 and 7 show another embodiment of an impeller according to the invention.
Figure 7:
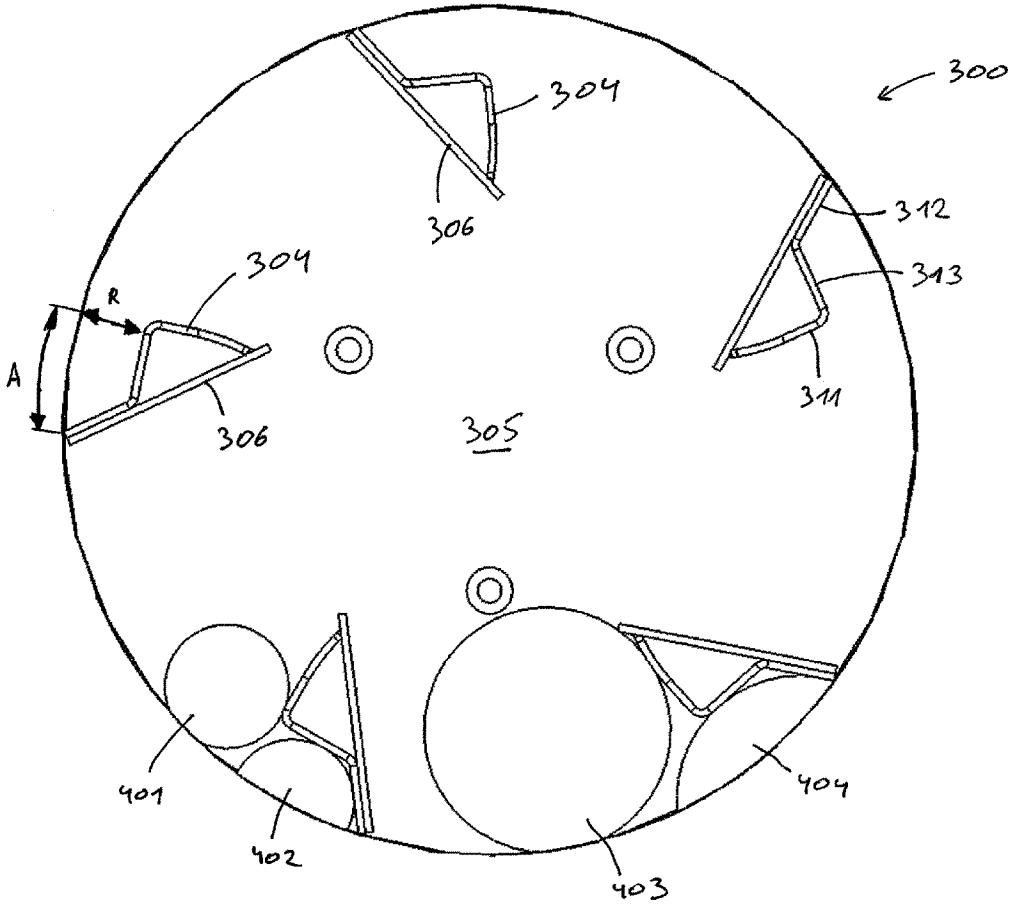

FIGS. 6 and 7 show a third embodiment of an impeller 300 according to the invention, in use while cutting potatoes 401, 402, 403, 404. In this embodiment the first and second cutting stages are defined by inner 311 and outer parts 312 of bent sheet metal plates 304. In fact, the sheet metal plates 304 each comprise the inner paddle part 311 of which the outer edge defines the threshold size, a transitional part 313 where the gap up to the periphery slightly widens, so that the cut product can move instantly from the first to the second stage, and then the outer paddle part 312. At the back side of these bent sheet metal plates a urethane plate 306 is provided for killing the blow from the initial strike on the food product entering the cutting head. Shown are 2" and 4" diameter potatoes being cut, which is the likely range for the potato industry. The sheet metal provides a cost advantage with respect to prior art impeller constructions. Since it is bent it can be quite strong; its thickness can for example be in the range 2.0-10.0 mm, preferably in the range 2.0-5.0 mm.

Figure 8:
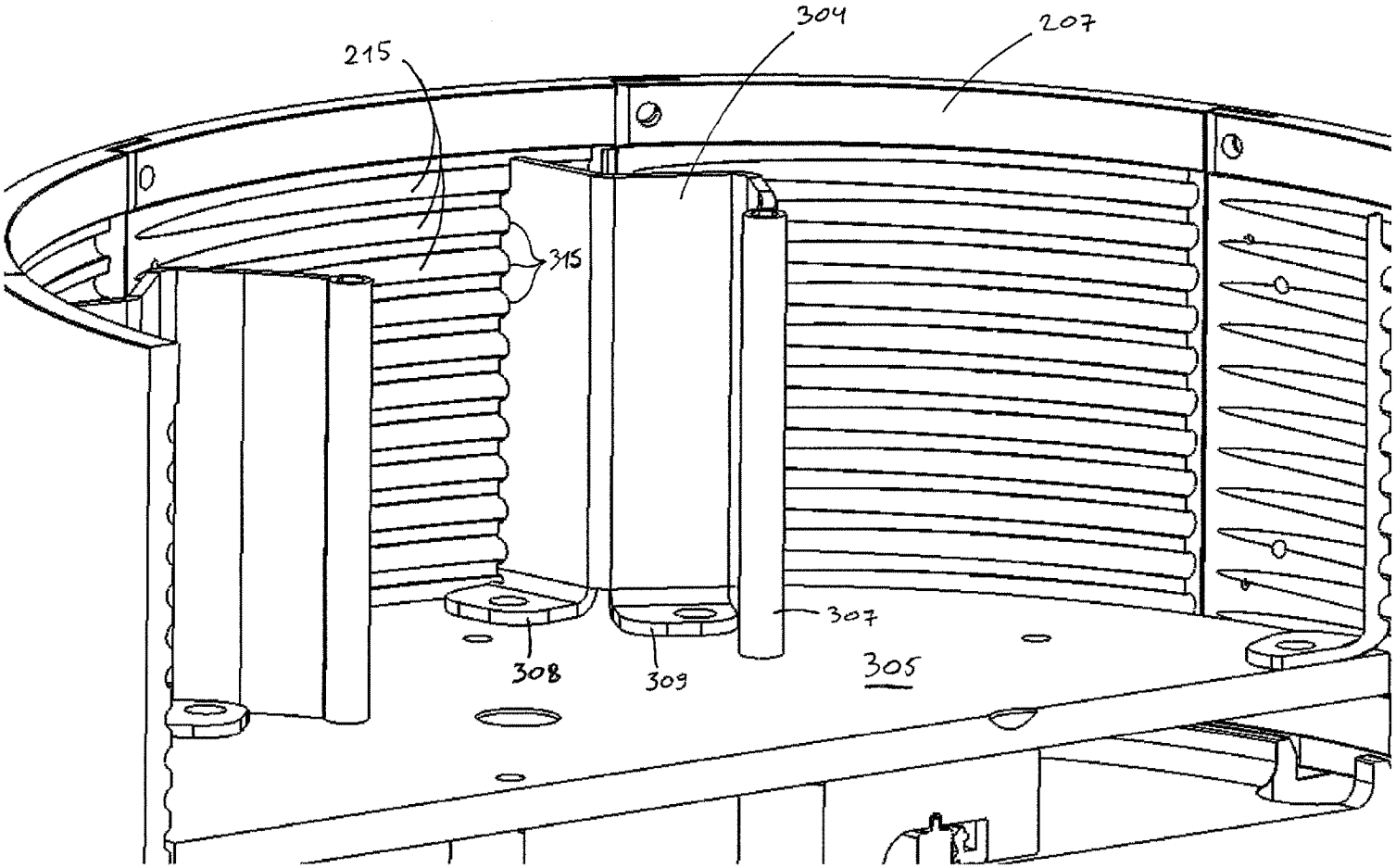
FIGS. 8 and 9 shows details of parts of the centrifugal cutting apparatus of FIG. 2.

As shown in FIG. 8, the sheet metal paddles 304 can be provided with radius grooves 315 on the peripheral edge to provide relief for small stones which may accidentally enter the cutting head. These radius grooves can be aligned with corresponding grooves 215 in the cutting stations 207 of the cutting head.

In the embodiment shown in FIG. 8, the urethane plate has been replaced by a resilient covering 307 of only the innermost edge of the paddles 304. It is further shown that the sheet metal paddles 304 comprise fixing parts 308, 309 which are bent from the same sheet metal blank and by means of which the paddles 304 are releasably fixed to the base plate 305 of the impeller 300. Different sets of mounting bores can be provided in the base plate 305, so that the paddles 304 can be mounted in different positions and/or orientations.

The cutting apparatus shown in FIGS. 10-14 has many features in common with the cutting apparatus shown in FIG. 2. As a result, only the differences will be explained in detail.

The cutting apparatus shown in FIGS. 10-14 is mainly different in the driving mechanisms used to drive the impeller 500 and the cutting head 600. For both, an in line drive mechanism is used, i.e. the impeller 500 is directly fixed to the shaft of the motor 503 and the cutting head 600 is directly fixed to the shaft of the motor 603. This has the advantage that any intermediate drive components, such as the driving belts and the concentric shafts of the apparatus of FIG. 2 are avoided, which simplifies the construction. The concentric rotation of the impeller 500 inside the cutting head 600 is stabilised by means of a spring-loaded pin 501 which fits into a tapered hole 601 in the centre of the cutting head 600.

The cutting head 600 is in this embodiment an assembly of cutting stations 607, placed on a spider support 609. The spider support 609 is used instead of a full bottom plate in order to save weight. The spider support can be connected to the shaft of the motor 603 by means of notches which are engaged by pins on the shaft. This can be a quick release engagement which can be fixed/loosened by for example turning the spider support 609 over +5°/−5° with respect to the motor shaft. Of course, the spider support 609 could also be bolted to the motor shaft, or releasably fixed by any other means known to the person skilled in the art.

Figure 14:
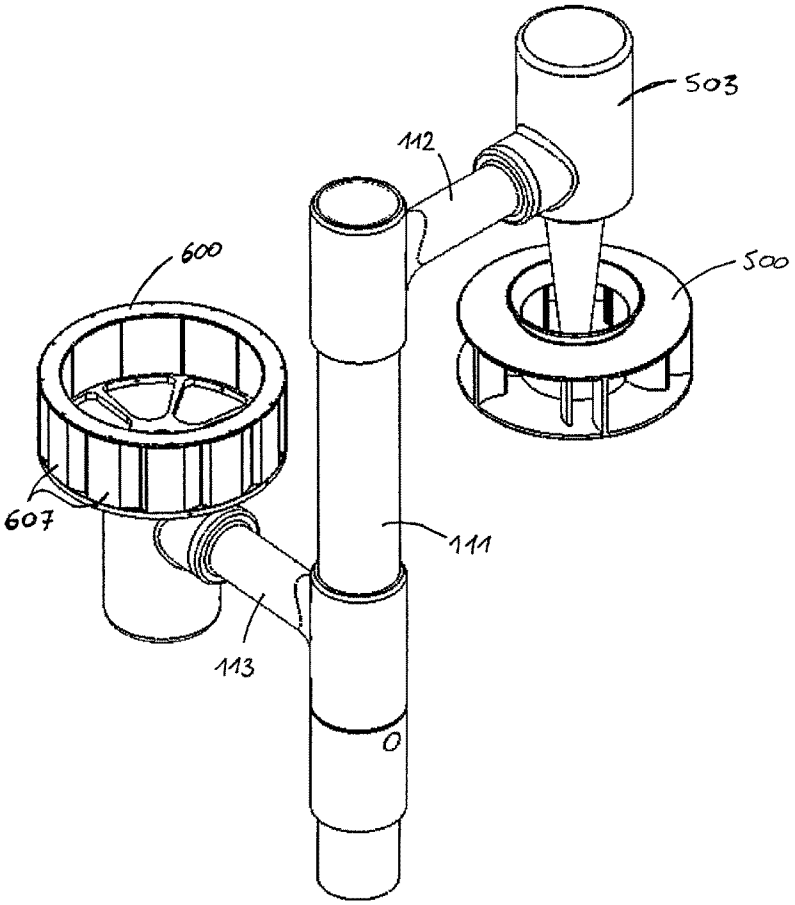
Figure 13:
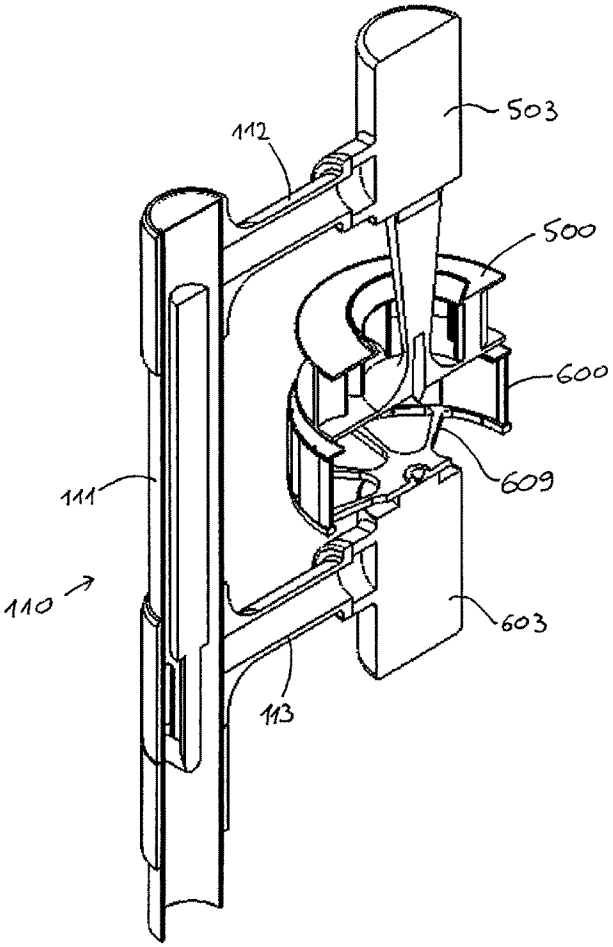

In this embodiment, the base 110 comprises a vertical post 111 with a fixed top arm 112 on which the impeller motor 503 is mounted with the shaft pointing downwards. The cutting head motor 603 is mounted on the post 111 with the shaft pointing upwards by means of a vertically movable and horizontally rotatable arm 113. In this way, the cutting head 600 can be removed from the impeller 500 for maintenance, replacement, etc. by subsequently moving the arm 113 downwards (FIG. 13) and rotating it in a horizontal plane (FIG. 14).

Below, the operation of the cutting apparatus of the invention will be discussed in general by reference to FIGS. 15-17. In these figures, the cutting elements 208 of the cutting head 200 are oriented to impart cutting action in counterclockwise direction, i.e. the cutting elements cut through the product in counterclockwise direction or, alternatively stated, the product passes the cutting elements in clockwise direction. This is the mode of operation which is used in the art (with stationary cutting heads), but it is evident that the orientation of the cutting elements can be turned around to impart cutting action in clockwise direction. The arrows $v_{CH}$ and $v_{IMP}$ on these figures respectively represent the rotational speed of the cutting head and the rotational speed of the impeller.

Figure 15:
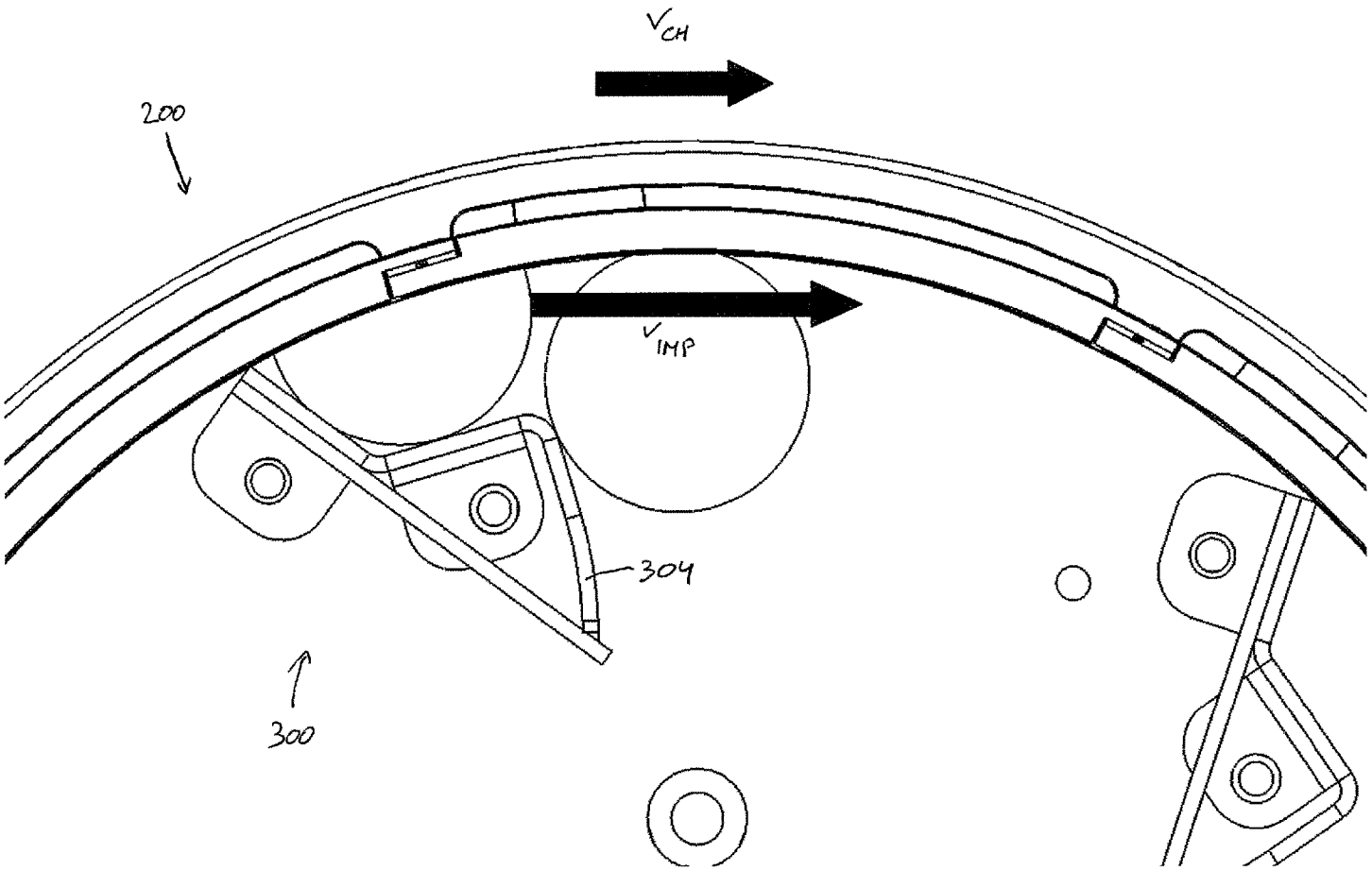
FIGS. 15-17 show the operation of centrifugal cutting apparatuses according to the invention.

In the situation of FIG. 15, the impeller 300 and the cutting head 200 rotate in the same direction, namely both clockwise. They rotate at different rotational speeds, i.e. the cutting head is not stationary with respect to the impeller. The first rotational speed $v_{IMP}$ of the impeller 300 is greater than the second rotational speed $v_{CH}$ of the cutting head 200, so that the paddles 304 of the impeller move the product towards the cutting elements 208. The first rotational speed of the impeller 300 sets the centrifugal force exerted on the product, i.e. the force with which the product is pressed against the interior of the cutting stations 207. The difference in rotational speed sets the cutting velocity with which the cutting elements 208 cut through the product, which is pushed towards them by means of the paddles 304 of the impeller.

Figure 16:
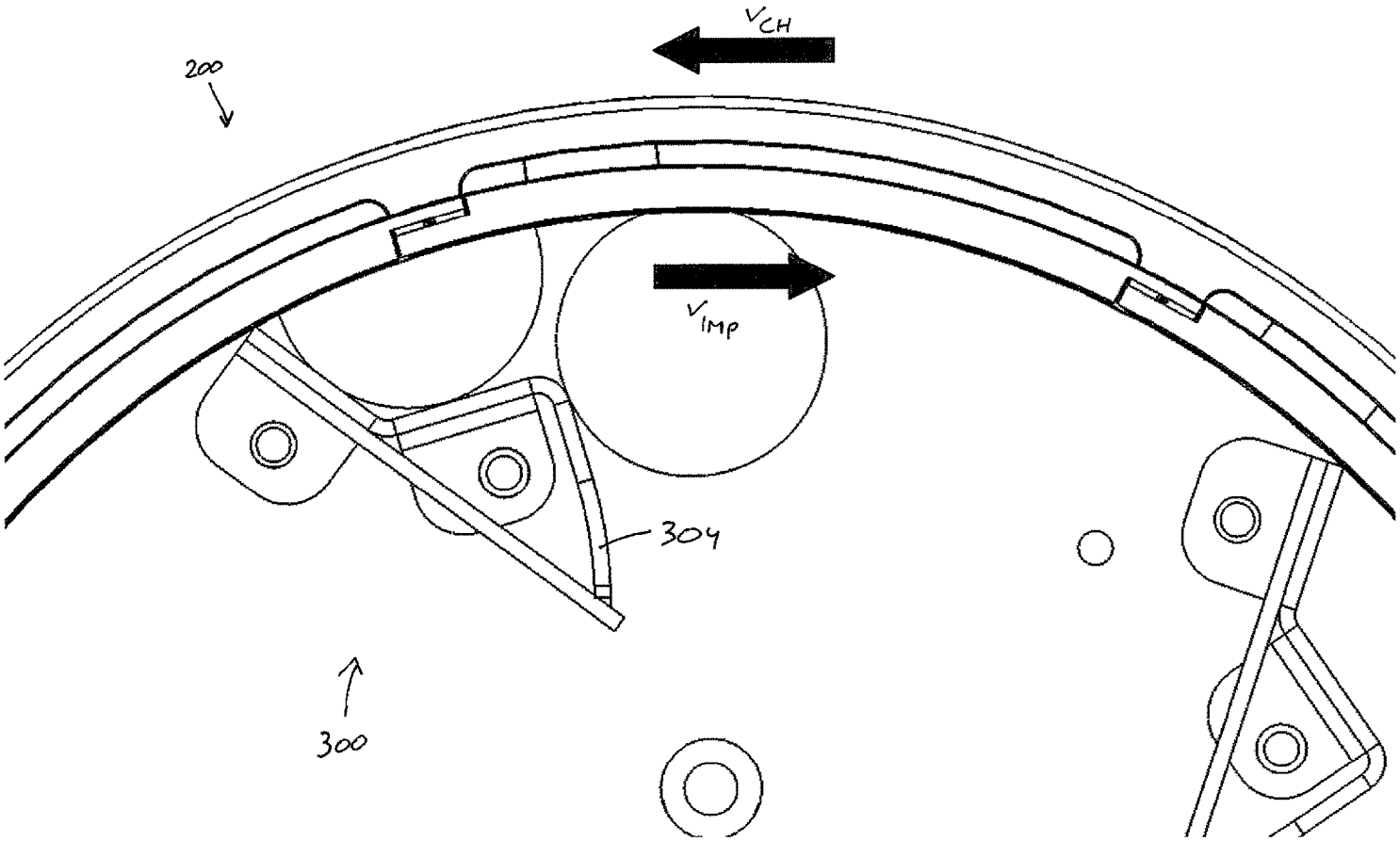
Figure 17:
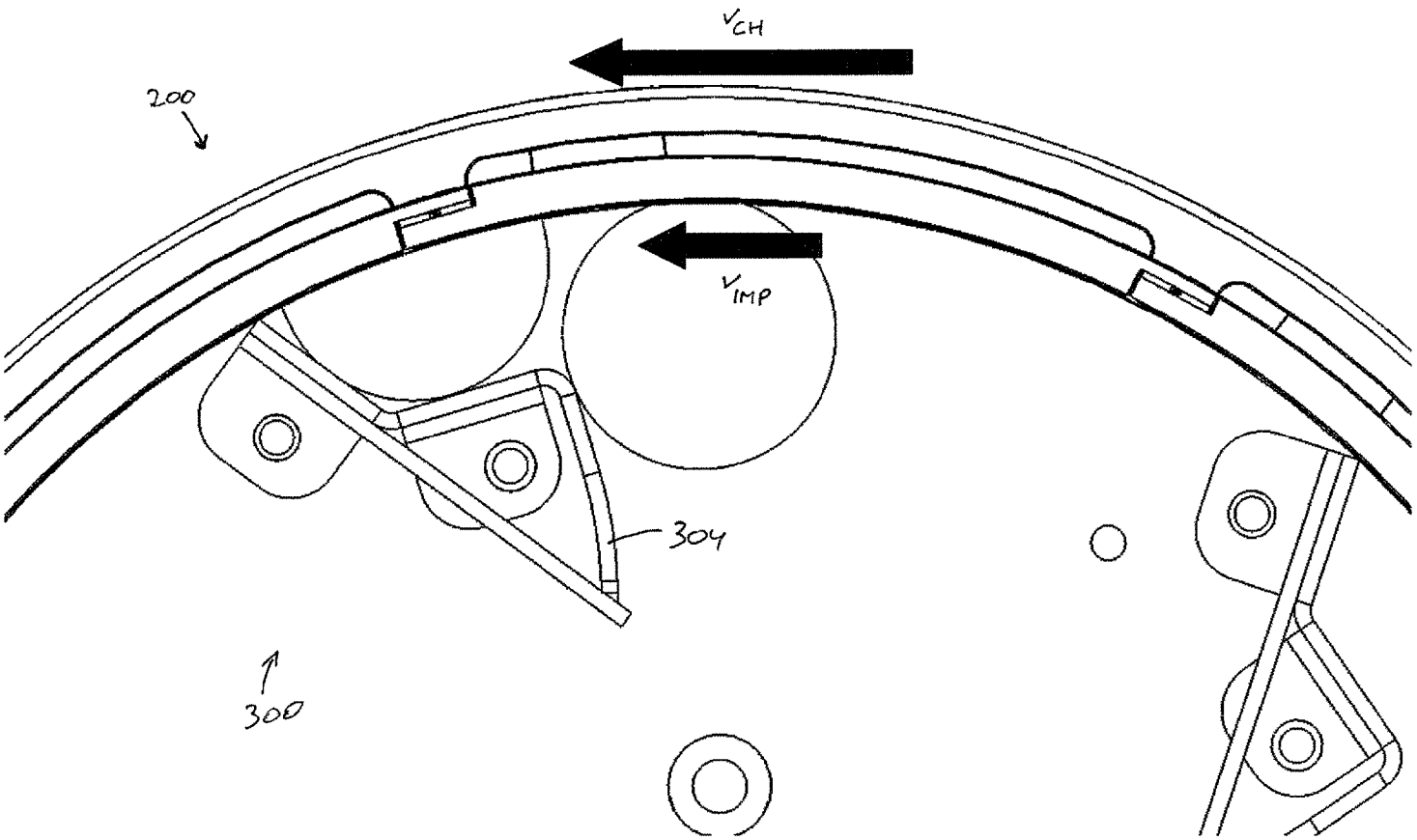

In the situation of FIG. 16, the impeller 300 and the cutting head 200 rotate in opposite directions, namely the impeller 300 rotates clockwise and the cutting head 200 rotates counterclockwise. In this situation, the first and second rotational speeds $v_{IMP}$ and $v_{CH}$ can be equal or different in absolute value. The first rotational speed $v_{IMP}$ of the impeller 300 sets the centrifugal force. The cutting velocity is related to the sum of the absolute values of the rotational speeds $v_{CH}$ and $v_{IMP}$, as their direction is opposite.

In the situation of FIG. 20, the impeller 300 and the cutting head 200 rotate in the same direction, namely both counterclockwise, with the impeller 300 at a smaller rotational speed than the cutting head 200. The first rotational speed $v_{IMP}$ of the impeller 300 sets the centrifugal force. As the first rotational speed $v_{IMP}$ is smaller than the second rotational speed $v_{CH}$, the cutting elements 208 move towards the paddles 304, so towards the product to be cut. The cutting velocity is determined by the difference between the first and second rotational speeds.

Figure 18:
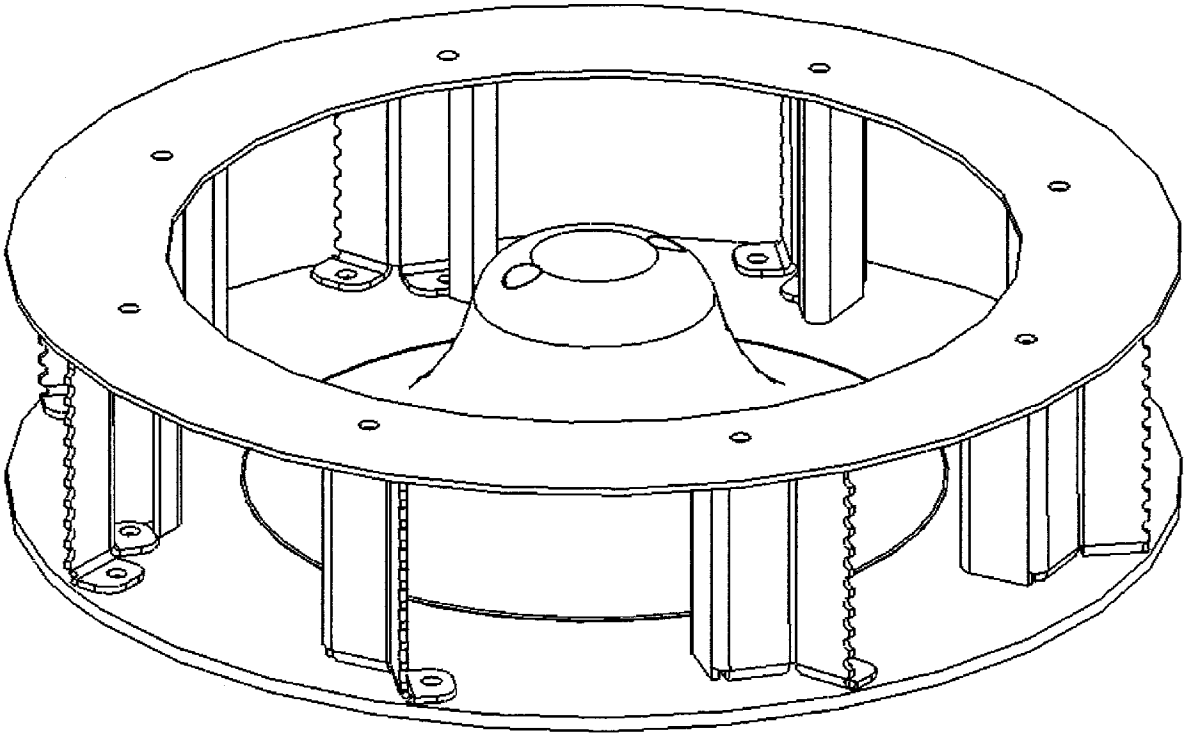
FIG. 18 shows another embodiment of an impeller according to the invention.

FIG. 18 shows another embodiment of an impeller according to the invention. It has an inner cone used to urge the product outward as the product falls into the top opening of the cutting head and onto the cone, which is advantageous with the use of a larger diameter of cutting heads, e.g. larger than 14" diameter. The shape of the cone does not have to be a radius, anything other than vertical is also possible. This cone can also have a cavity in the top so that water can be supplied in the top and will be released out through holes in a very specific location related to the product position while being cut. The cone presents clear advantages for larger diameters, e.g. larger than the current 14" diameter used today, because the middle of the impeller becomes a dead zone at slower impeller rotational speeds and it for larger diameters one can reduce the impeller rotational speed with respect to smaller diameters if the same G force is desired at the periphery (e.g. 10.5 G).

The invention claimed is:

1. Impeller for a centrifugal food cutting apparatus, provided for being concentrically rotated within a cutting head, comprising a base plate having a central zone for receiving food products to be cut by said cutting head and a plurality of impeller paddles arranged in sets outside said central zone, the impeller paddles being mounted on the base plate and being provided for imparting centrifugal force to said food products to be cut, wherein each set of impeller paddles comprises an inner paddle and an outer paddle, the inner paddles being arranged on an inner circle and defining a first stage for food product which is present on the impeller wherein the food product is impelled by one of the inner paddles, the outer paddles being arranged on an outer circle and defining a second cutting stage for food product present on the impeller wherein the food product is impelled by one of the outer paddles while being cut by cutting elements of the cutting head, the second cutting stage being subsequent to the first stage, the inner and outer paddles of each set being offset from each other both in radial and angular directions of the impeller, such that they together define a safe compartment for the food product which is in the second cutting stage wherein the food product is protected from being touched by subsequent food product which is fed onto the impeller.

2. Impeller according to claim 1, wherein the first stage is a first cutting stage in which the food product is above a threshold size and is held in a first position by one of said inner paddles while being cut.

3. Impeller according to claim 1, wherein the first stage is a non-cutting stage in which the food product is held in a first position by one of said inner paddles without being cut.

4. Impeller according to claim 1, wherein the impeller further comprises intermediate paddles arranged on an intermediate circle between the inner and outer circles and defining at least one intermediate cutting stage between the first and second stages wherein the food product is impelled by one of the intermediate paddles while being cut by the cutting elements of the cutting head, the at least one intermediate cutting stage being subsequent to the first stage and the at least one intermediate cutting stage preceding the second cutting stage.

5. Impeller according to claim 1, wherein the inner and outer paddles are separate parts.

6. Impeller according to claim 1, wherein the paddles have textured surfaces to counteract counterrotation of the food product in contact with the surface.

7. Impeller according to claim 1, wherein the paddles have curved surfaces.

8. Impeller according to claim 1, wherein the inner and outer paddles are oriented under different angles with respect to the radial direction of the impeller.

9. Impeller according to claim 8, wherein the outer paddles are oriented at a greater angle with respect to the radial direction of the impeller than the inner paddles.

10. Impeller according to claim 1, wherein the inner and outer paddles are rotatably mounted on the impeller.

11. Impeller according to claim 1, wherein the paddles are repositionally mounted on the impeller.

12. Impeller according to claim 1, provided for cutting potatoes, wherein the offset in angular direction between the inner and outer paddles of each set is in the range from 4.0 to 6.0 cm.

13. Impeller according to claim 1, provided for cutting potatoes, wherein the distance between the inner paddles and the periphery of the impeller is in the range from 2.5 to 5.0 cm.

14. Impeller according to claim 1, wherein the back side of the paddles is covered with a resilient material.

15. Centrifugal food cutting apparatus comprising:

a cutting head comprising at least one cutting element;

an impeller concentrically rotatable within the cutting head, the impeller comprising a base plate having a central zone for receiving food products to be cut by said cutting head and a plurality of impeller paddles arranged in sets outside said central zone, the impeller paddles being mounted on the base plate and being provided for imparting centrifugal force to said food products to be cut, wherein each set of impeller paddles comprises an inner paddle and an outer paddle, the inner paddles being arranged on an inner circle and defining a first stage for food product which is present on the impeller wherein the food product is impelled by one of the inner paddles, the outer paddles being arranged on an outer circle and defining a second cutting stage for food product present on the impeller wherein the food product is impelled by one of the outer paddles while being cut by the at least one cutting element of the cutting head, the second cutting stage being subsequent to the first stage, the inner and outer paddles of each set being offset from each other both in radial and angular directions of the impeller, such that they together define a safe compartment for the food product which is in the second cutting stage wherein the food product is protected from being touched by subsequent food product which is fed onto the impeller; and a first drive mechanism for driving the rotation of the impeller.

16. Centrifugal food cutting apparatus according to claim 15, wherein a first threshold size is defined by the distance between the inner paddles and the at least one cutting element.

17. Centrifugal food cutting apparatus according to claim 16, wherein a second threshold size is defined by the distance between the intermediate paddles and the at least one cutting element.

18. Centrifugal food cutting apparatus according to claim 15, wherein the outer paddles are provided with radius grooves on the peripheral edge to provide relief for small stones which may accidentally enter the cutting head.

19. Centrifugal food cutting apparatus according to claim 18, wherein the radius grooves are aligned with corresponding grooves in cutting stations of the cutting head.

20. Centrifugal food cutting apparatus according to claim 15, wherein the cutting head is rotatably mounted on the apparatus and wherein a second drive mechanism is provided for driving the rotation of the cutting head.

* * * * *